US010638848B1

(12) United States Patent
Wesley et al.

(10) Patent No.: US 10,638,848 B1
(45) Date of Patent: May 5, 2020

(54) PARCEL STORAGE BENCH ASSEMBLY

(71) Applicants: Des Moines Wesley, Wichita Falls, TX (US); Billie Wesley, Wichita Falls, TX (US)

(72) Inventors: Des Moines Wesley, Wichita Falls, TX (US); Billie Wesley, Wichita Falls, TX (US)

( * ) Notice: Subject to any disclaimer, the term of this patent is extended or adjusted under 35 U.S.C. 154(b) by 0 days.

(21) Appl. No.: 16/190,282

(22) Filed: Nov. 14, 2018

(51) Int. Cl.
*A47C 7/62* (2006.01)
*A47C 11/00* (2006.01)
*A47G 29/14* (2006.01)

(52) U.S. Cl.
CPC ..... *A47C 7/628* (2018.08); *A47C 11/00* (2013.01); *A47G 29/141* (2013.01)

(58) Field of Classification Search
CPC ..... A47G 29/14; A47G 29/141; A47G 29/16; A47G 29/20; A47G 29/22; A47G 2029/1257; A47G 2029/144; A47G 2029/148; B65D 55/14; A47C 13/00; A47C 7/628; A47C 11/00
USPC ..... 232/44, 45, 38, 39, 19; 297/118; 70/63
See application file for complete search history.

(56) References Cited

U.S. PATENT DOCUMENTS 986,686 A 3/1911 Carney
1,309,097 A * 7/1919 Markwick ..... A47B 85/04 297/123
2,682,915 A 7/1954 Forti
5,884,795 A * 3/1999 Godbersen ..... A45C 15/00 220/23.86
5,979,750 A 11/1999 Kindell
D432,322 S 10/2000 Mandell
6,300,873 B1 * 10/2001 Kucharczyk ..... A47G 29/141 235/382.5
6,375,070 B1 * 4/2002 Snoke ..... A47G 29/141 232/20
6,967,575 B1 11/2005 Dohrmann
7,175,071 B1 * 2/2007 Slagle ..... A47G 29/16 220/833
7,337,944 B2 3/2008 Devar
7,597,256 B2 10/2009 Stevens
8,358,199 B2 * 1/2013 Nesling ..... A47G 29/141 232/20
9,526,342 B2 12/2016 Thuma
10,039,401 B1 * 8/2018 Romanucci ..... A47G 29/141
10,292,519 B1 * 5/2019 Sutton ..... A47G 29/1209
2001/0045449 A1 * 11/2001 Shannon ..... A47G 29/141 232/19
2016/0309939 A1 * 10/2016 Mencel ..... A47G 29/20
(Continued)

FOREIGN PATENT DOCUMENTS

WO WO0266344 8/2002

*Primary Examiner* — William L Miller

(57) ABSTRACT

A parcel storage bench assembly for securing a delivered parcel for an authorized user includes a bench that is positionable proximate a parcel delivery location of a building. The bench has a storage compartment integrated therein for receiving a parcel. Moreover, the bench has a lid thereon for opening and closing the storage compartment. A combination lock is coupled to the bench and the combination lock engaging the lid when the lid is closed. Thus, the combination lock secures the parcel in the bench. A predetermined code is selectively entered into the combination lock by an authorized user thereby facilitating the authorized user to open the lid and remove the parcel from the bench.

8 Claims, 5 Drawing Sheets

(56) References Cited

U.S. PATENT DOCUMENTS

| | | | | |
|---|---|---|---|---|
| 2017/0251856 | A1* | 9/2017 | Schaible | A47G 29/141 |
| 2018/0070753 | A1* | 3/2018 | Eveloff | H04W 12/08 |
| 2018/0303265 | A1* | 10/2018 | Hearne | A47G 29/12095 |
| 2018/0310714 | A1* | 11/2018 | Becker | A47C 11/00 |
| 2019/0000255 | A1* | 1/2019 | Dehner | B65D 43/164 |
| 2019/0167025 | A1* | 6/2019 | Cherry | A47G 29/141 |
| 2019/0239650 | A1* | 8/2019 | Nelson | A47C 1/14 |
| 2019/0239673 | A1* | 8/2019 | Silva | A47G 29/28 |

* cited by examiner

PARCEL STORAGE BENCH ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to bench devices and more particularly pertains to a new bench device for storing a parcel for an authorized user.

BRIEF SUMMARY OF THE INVENTION

An embodiment of the disclosure meets the needs presented above by generally comprising a bench that is positionable proximate a parcel delivery location of a building. The bench has a storage compartment integrated therein for receiving a parcel. Moreover, the bench has a lid thereon for opening and closing the storage compartment. A combination lock is coupled to the bench and the combination lock engaging the lid when the lid is closed. Thus, the combination lock secures the parcel in the bench. A pre-determined code is selectively entered into the combination lock by an authorized user thereby facilitating the authorized user to open the lid and remove the parcel from the bench.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
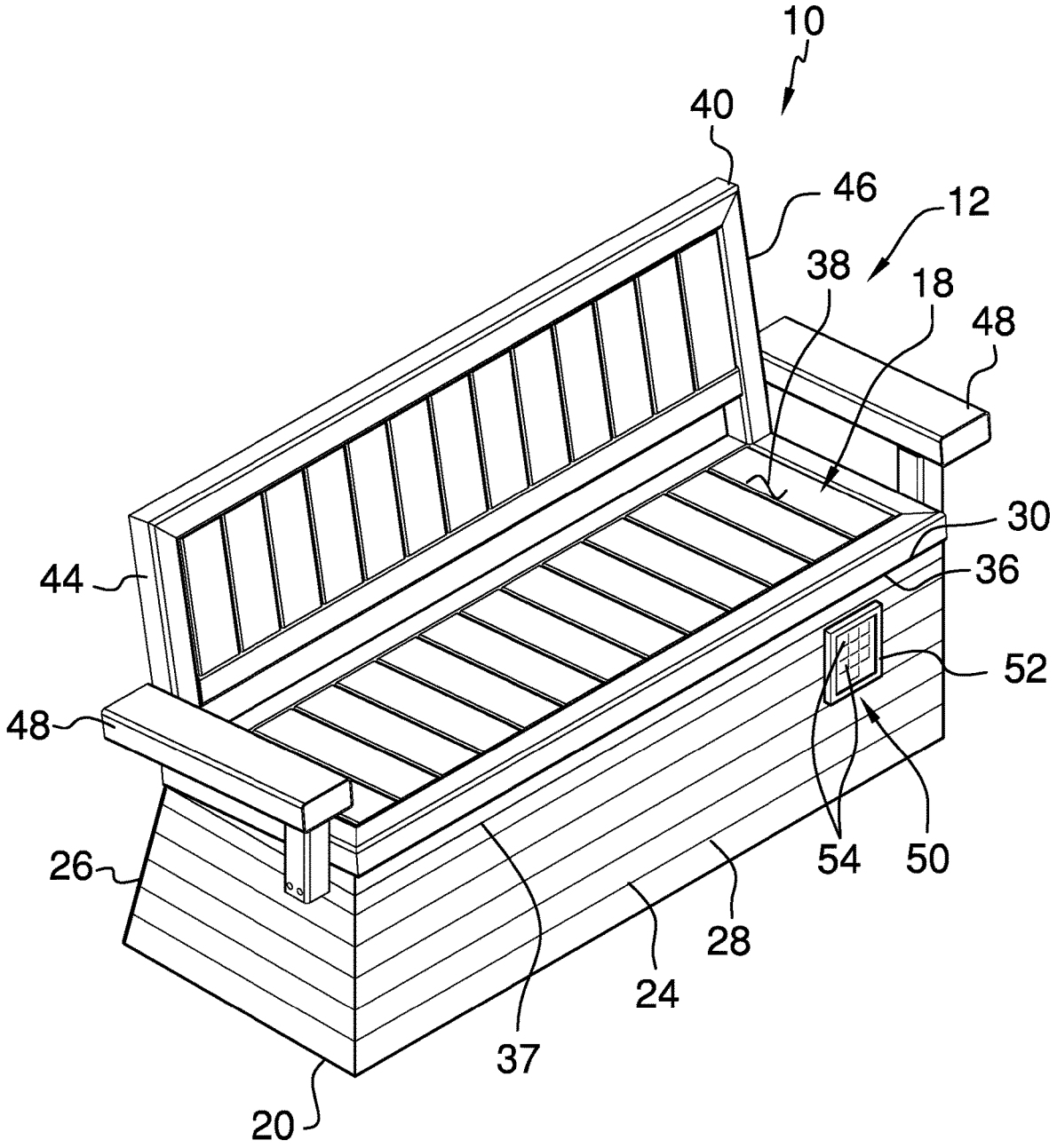
FIG. 1 is a top perspective view of a parcel storage bench assembly according to an embodiment of the disclosure.
Figure 2:
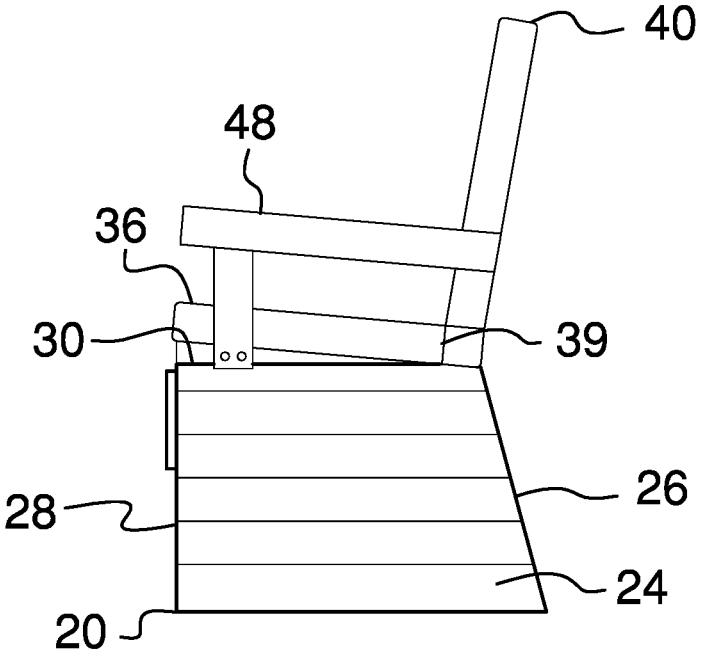
FIG. 2 is a left side view of an embodiment of the disclosure.
Figure 3:
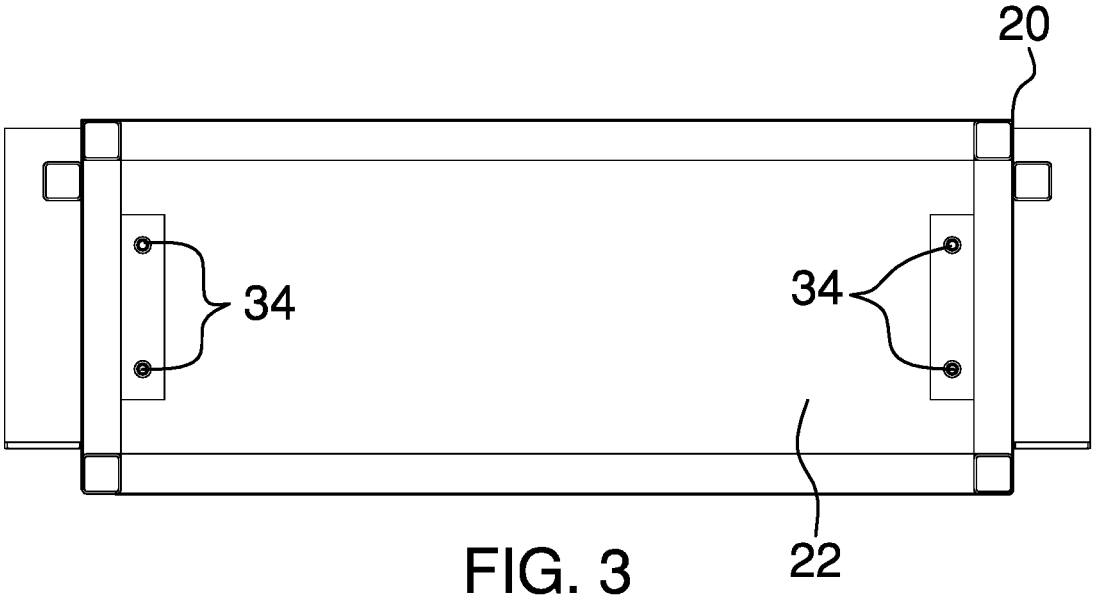
FIG. 3 is a bottom view of an embodiment of the disclosure.
Figure 4:
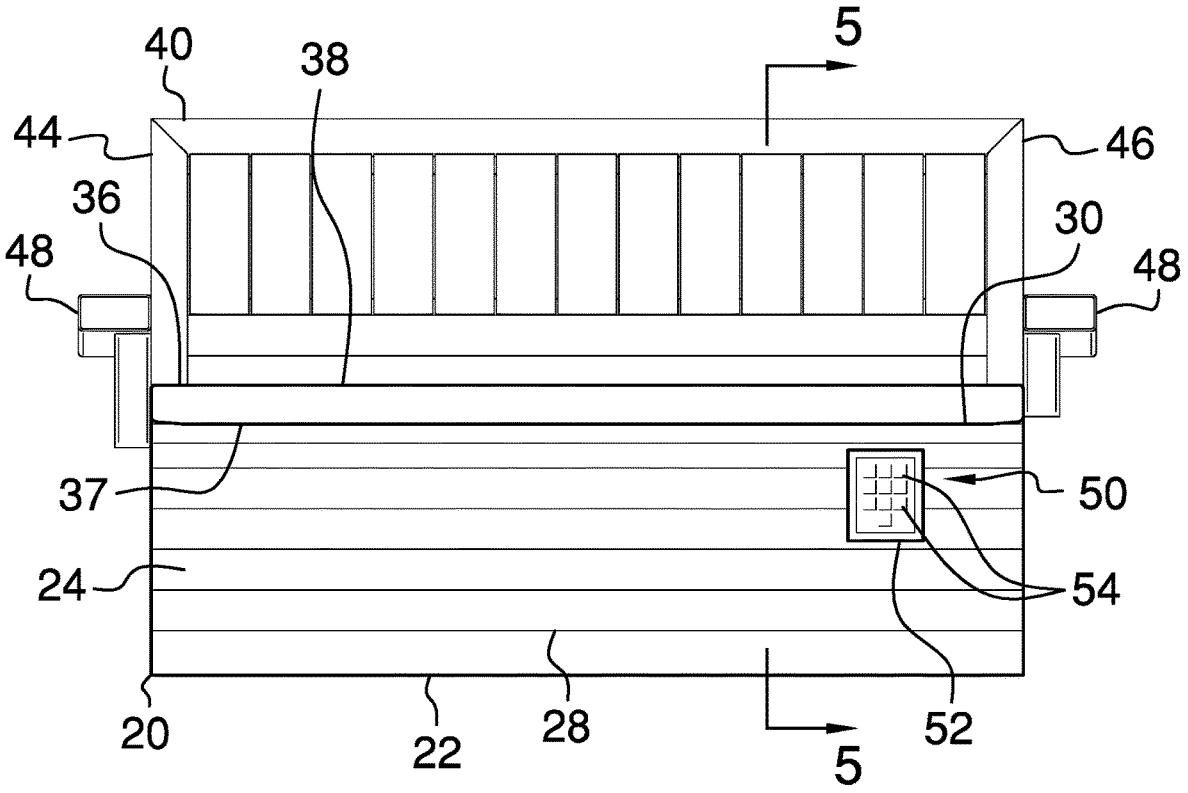
FIG. 4 is a front view of an embodiment of the disclosure.
Figure 5:
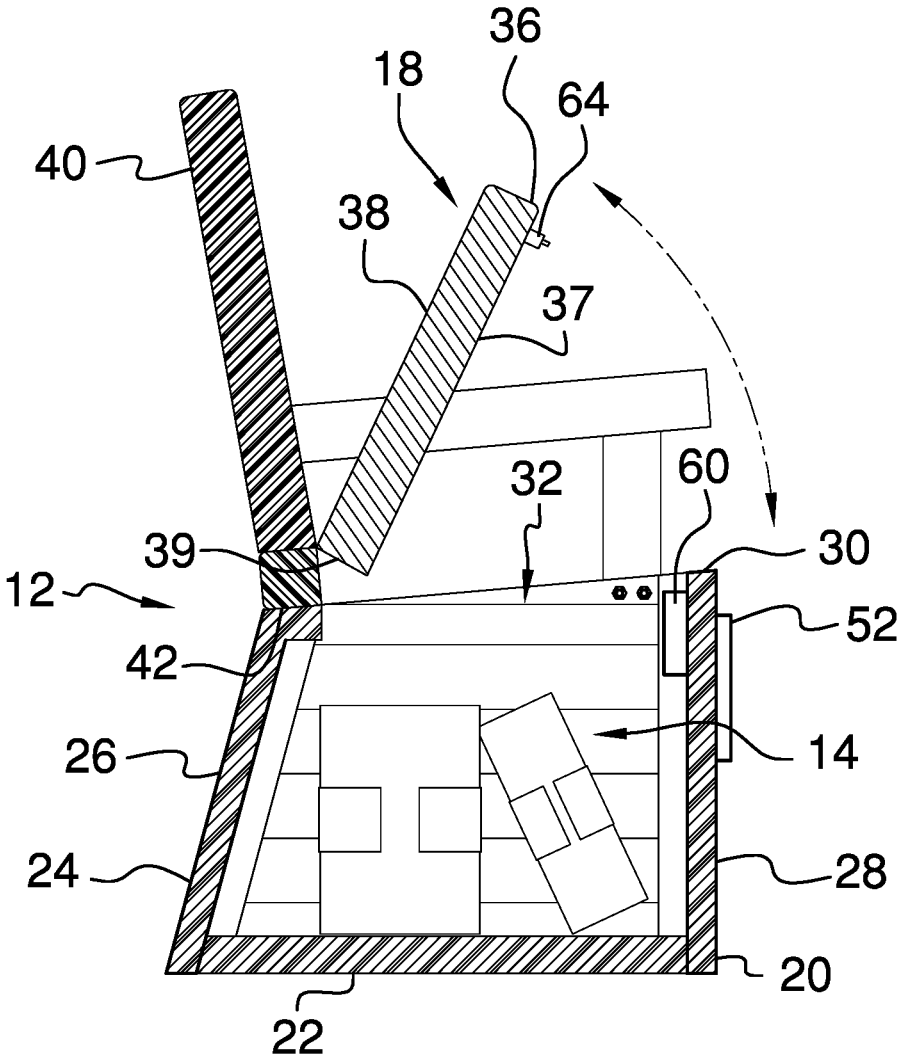
FIG. 5 is a cross sectional view taken along line 5-5 of FIG. 4 of an embodiment of the disclosure.
Figure 6:
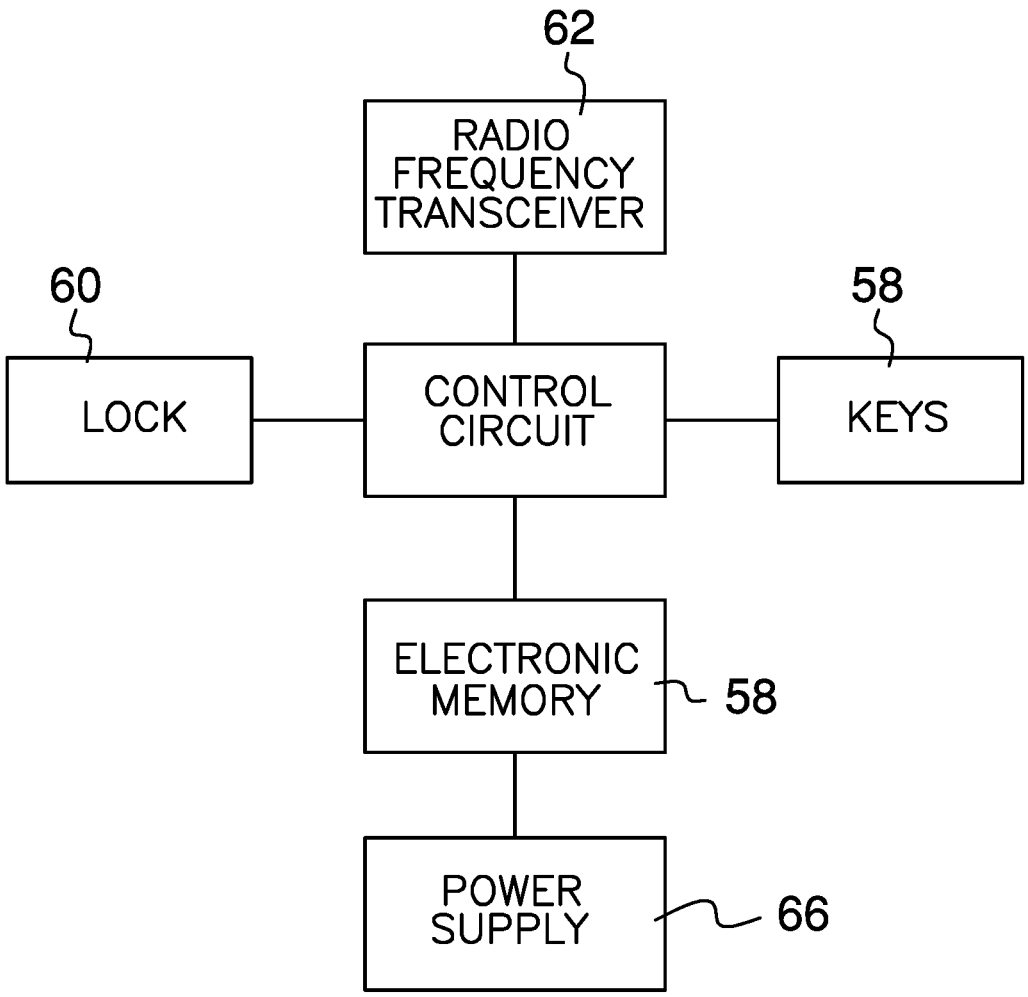
FIG. 6 is a schematic view of an embodiment of the disclosure.

With reference now to the drawings, and in particular to FIGS. 1 through 6 thereof, a new bench device embodying the principles and concepts of an embodiment of the disclosure and generally designated by the reference numeral 10 will be described.

As best illustrated in FIGS. 1 through 6, the parcel storage bench assembly 10 generally comprises a bench 12 that is positionable proximate a parcel delivery location of a building. The building may be a residence or other type of building that commonly receives unattended parcel deliveries. The bench 12 has a storage compartment 14 being integrated therein for receiving a parcel 16. Moreover, the bench 12 has a lid 18 thereon for opening and closing the storage compartment 14.

The bench 12 comprises a box 20 that has bottom wall 22 and an outer wall 24 extending upwardly therefrom. The outer wall 24 has a rear side 26, a front side 28 and a distal edge 30 with respect to the bottom wall 22 defining an opening 32 into the box 20. Thus, an interior of the box 20 defines the storage compartment 14 to receive the delivered parcel 16. The rear side 26 slopes toward the front side 28 between the bottom wall 22 and the distal edge 30, and the distal edge 30 may slope downwardly between the front 28 and rear 26 sides of the outer wall 24 of the box 20. The bottom wall 22 has a plurality of fastener apertures 34 each extending therethrough. Each of the fastener apertures 34 has a respective one of a plurality of fasteners extending therethrough and engaging a support surface for fastening the box 20 to the support surface. In this way the box 20 is inhibited from being stolen thereby ensuring the parcel 16 cannot be stolen.

A seat 36 is included that has a lower surface 37, a top surface 38 and a rear edge 39. The rear edge 39 is hingedly coupled to the distal edge 30 of the box 20 such that the seat 36 defines the lid 18 on the bench 12. The lower surface 37 rests on the distal edge 30 when the seat 36 is positioned in a lowered position thereby closing the opening 32 in the box 20. Alternatively, the seat 36 is positionable in an open position to access an interior of the box 20.

A backrest 40 is included that has a lower edge 42, a first lateral edge 44 and a second lateral edge 46. The lower edge 42 is coupled to the distal edge 30 of the outer wall 24 of the box 20 having the backrest 40 extending upwardly from the box 20 and having the backrest 40 angling rearwardly on the box 20. Moreover, the rear edge 39 of the seat 36 may be hingedly coupled to a front surface of the backrest 40. A pair of armrests 48 is each coupled between a respective one of the first 44 and second 46 lateral edges of the backrest 40 and the outer wall 24 of the box 20. The bench 12 may be comprised of wood slats, molded plastic or any other material common to outdoor furniture.

A combination lock 50 is provided and the combination lock 50 is coupled to the bench 12. The combination lock 50 engages the lid 18 when the lid 18 is closed to secure the parcel 16 in the bench 12. The combination lock 50 has a pre-determined code that can be entered therein by an authorized user. Thus, the authorized user can open the lid 18 and remove the parcel 16 from the bench 12.

The combination lock 50 comprises a key pad 52 that is coupled to the outer wall 24 of the box 20. The key pad 52 has a plurality of keys 54 thereon and each of the keys 54 is manipulated to enter the pre-determined code into the key pad 52. A control circuit 56 is positioned within the key pad 52 and each of the keys 54 on the key pad 52 is electrically coupled to the control circuit 56. The control circuit 56 includes an electronic memory 58 for storing the pre-determined code. Additionally, the control circuit 56 receives an unlock input when the pre-determined code is entered into the key pad 52.

A lock 60 is coupled to the key pad 52 and extends through the outer wall 24 of the box 20 such that the lock 60 is positioned within the box 20. The lock 60 is electrically coupled to the control circuit 56 and the lock 60 is normally actuated into a locking position. Moreover, the lock 60 is actuated into an unlocking position when the control circuit 56 receives the unlock 60 input. The lock 60 may be an electrically controlled lock of any conventional design commonly associated with locking doors or the like. The lock 60 may include a radio frequency transceiver 62 that is electrically coupled to the control circuit 56 thereby facilitating the lock 60 to be remotely actuated into the unlocked position via a Smartphone or other electronic device.

An engagement 64 is coupled to and extends downwardly from the lower surface 37 of the seat 36 and the engagement 64 is aligned with the lock 60. The engagement 64 engages the lock 60 when the seat 36 is in the lowered position such that the lock 60 inhibits the seat 36 from is positioned in the open position. In this way the lock 60 secures the parcel 16 within the box 20 thereby inhibiting the parcel 16 from being stolen. The lock 60 disengages the engagement 64 when the lock 60 is actuated into the unlocking position thereby facilitating the seat 36 to be positioned in the open position. In this way the lock 60 facilitates the parcel 16 to be removed from the box 20. A power supply 66 is positioned within the key pad 52, the power supply 66 is electrically coupled to the control circuit 56 and the power supply 66 comprising at least one battery.

In use, the authorized user communicates the pre-determined code to the delivery service thereby facilitating the delivery person to open the seat 36 and place the parcel 16 into the box 20. The delivery person subsequently closes the seat 36 and the lock 60 engages the engagement 64 thereby securing the parcel 16 in the box 20. Thus, the authorized user can subsequently enter the pre-determined code into the key pad 52 for retrieving the parcel 16 from the box 20. Additionally, the authorized user can potentially remotely unlock the lock 60 via the radio frequency transceiver when the delivery person arrives at the box 20 to deliver the parcel 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A parcel storage bench assembly being configured to receive and subsequently secure a parcel for a recipient, said assembly comprising:

a bench being positionable proximate a parcel delivery location of a building, said bench having a storage compartment being integrated therein for receiving a parcel, said bench having a lid thereon for opening and closing said storage compartment;

a combination lock being coupled to said bench, said combination lock engaging said lid when said lid is closed wherein said combination lock is configured to secure the parcel in said bench, said combination lock having a pre-determined code being entered therein by an authorized user thereby facilitating the authorized user to open said lid and remove the parcel from said bench;

said bench comprising a box having bottom wall and an outer wall extending upwardly therefrom, said outer wall having a rear side, a front side and a distal edge with respect to said bottom wall defining an opening into said box having an interior of said box defining said storage compartment wherein said opening is configured to receive a delivered parcel;

said rear side sloping toward said front side between said bottom wall and said distal edge; and said bottom wall having a plurality of fastener apertures each extending therethrough, each of said fastener apertures having a respective one of a plurality of fasteners extending therethrough and engaging a support surface for fastening said box to the support surface wherein said box is configured to be inhibited from being stolen.

2. The assembly according to claim 1, further comprising a seat having a lower surface, a top surface and a rear edge, said rear edge being hingedly coupled to a distal edge of said box such that said seat defines said lid on said bench, said lower surface resting on said distal edge when said seat is positioned in a lowered position thereby closing said opening in said box, said seat being positionable in an open position to access an interior of said box.

3. The assembly according to claim 1, wherein said combination lock comprises:

a key pad being coupled to said outer wall of said box, said key pad having a plurality of keys thereon, each of said keys being manipulated to enter said pre-determined code into said key pad; and a control circuit being positioned within said key pad, each of said keys on said key pad being electrically coupled to said control circuit, said control circuit including an electronic memory for storing said predetermined code, said control circuit receiving an unlock input when said pre-determined code is entered into said key pad.

4. The assembly according to claim 3, further comprising a lock being coupled to said key pad and extending through said outer wall of said box such that said lock is positioned within said box, said lock being electrically coupled to said control circuit, said lock being normally actuated into a locking position, said lock being actuated into an unlocking position when said control circuit receives said unlock input.

5. The assembly according to claim 4, further comprising an engagement being coupled to and extending downwardly from said lower surface of said seat, said engagement being aligned with said lock, said engagement engaging said lock when said seat is in said lowered position such that said lock inhibits said seat from being positioned in said open position wherein said lock is configured to secure the parcel within said box, said lock disengaging said engagement when said lock is actuated into said unlocking position thereby facilitating said seat to be positioned in said open position wherein said lock is configured to facilitate the parcel to be removed from said box.

6. The assembly according to claim 3, further comprising a power supply being positioned within said key pad, said power supply being electrically coupled to said control circuit, said power supply comprising at least one battery.

7. A parcel storage bench assembly being configured to receive and subsequently secure a parcel for a recipient, said assembly comprising:

a bench being positionable proximate a parcel delivery location of a building, said bench having a storage compartment being integrated therein for receiving a parcel, said bench having a lid thereon for opening and closing said storage compartment;

a combination lock being coupled to said bench, said combination lock engaging said lid when said lid is closed wherein said combination lock is configured to secure the parcel in said bench, said combination lock having a pre-determined code being entered therein by an authorized user thereby facilitating the authorized user to open said lid and remove the parcel from said bench;

a backrest having a lower edge, a first lateral edge and a second lateral edge, said lower edge being coupled to a distal edge of an outer wall of said box having said backrest extending upwardly from said box, said backrest angling rearwardly on said box; and a pair of armrests, each of said armrests being coupled between a respective one of said first and second lateral edges of said backrest and said outer wall of said box.

8. A parcel storage bench assembly being configured to receive and subsequently secure a parcel for a recipient, said assembly comprising:

a bench being positionable proximate a parcel delivery location of a building, said bench having a storage compartment being integrated therein for receiving a parcel, said bench having a lid thereon for opening and closing said storage compartment, said bench comprising:

a box having bottom wall and an outer wall extending upwardly therefrom, said outer wall having a rear side, a front side and a distal edge with respect to said bottom wall defining an opening into said box having an interior of said box defining said storage compartment wherein said opening is configured to receive a delivered parcel, said rear side sloping toward said front side between said bottom wall and said distal edge, said bottom wall having a plurality of fastener apertures each extending therethrough, each of said fastener apertures having a respective one of a plurality of fasteners extending therethrough and engaging a support surface for fastening said box to the support surface wherein said box is configured to be inhibited from being stolen;

a seat having a lower surface, a top surface and a rear edge, said rear edge being hingedly coupled to said distal edge of said box such that said seat defines said lid on said bench, said lower surface resting on said distal edge when said seat is positioned in a lowered position thereby closing said opening in said box, said seat being positionable in an open position to access an interior of said box;

a backrest having a lower edge, a first lateral edge and a second lateral edge, said lower edge being coupled to said distal edge of said outer wall of said box having said backrest extending upwardly from said box, said backrest angling rearwardly on said box; and a pair of armrests, each of said armrests being coupled between a respective one of said first and second lateral edges of said backrest and said outer wall of said box; and a combination lock being coupled to said bench, said combination lock engaging said lid when said lid is closed wherein said combination lock is configured to secure the parcel in said bench, said combination lock having a pre-determined code being entered therein by an authorized user thereby facilitating the authorized user to open said lid and remove the parcel from said bench, said combination lock comprising:

a key pad being coupled to said outer wall of said box, said key pad having a plurality of keys thereon, each of said keys being manipulated to enter said pre-determined code into said key pad;

a control circuit being positioned within said key pad, each of said keys on said key pad being electrically coupled to said control circuit, said control circuit including an electronic memory for storing said pre-determined code, said control circuit receiving an unlock input when said pre-determined code is entered into said key pad;

a lock being coupled to said key pad and extending through said outer wall of said box such that said lock is positioned within said box, said lock being electrically coupled to said control circuit, said lock being normally actuated into a locking position, said lock being actuated into an unlocking position when said control circuit receives said unlock input;

an engagement being coupled to and extending downwardly from said lower surface of said seat, said engagement being aligned with said lock, said engagement engaging said lock when said seat is in said lowered position such that said lock inhibits said seat from being positioned in said open position wherein said lock is configured to secure the parcel within said box, said lock disengaging said engagement when said lock is actuated into said unlocking position thereby facilitating said seat to be positioned in said open position wherein said lock is configured to facilitate the parcel to be removed from said box; and a power supply being positioned within said key pad, said power supply being electrically coupled to said control circuit, said power supply comprising at least one battery.

* * * * *